United States Patent [19]

Gorrafa

[11] 3,973,386

[45] Aug. 10, 1976

[54] PROCESS FOR TEXTURING POLYESTER YARN

[75] Inventor: Adly Abdel-moniem Gorrafa, Hockessin, Del.

[73] Assignee: E. I. Du Pont de Nemours and Company, Wilmington, Del.

[22] Filed: Aug. 14, 1974

[21] Appl. No.: 497,489

[52] U.S. Cl. ..... 57/157 TS; 28/72.11; 57/34 HS; 57/157 F

[51] Int. Cl.[2] ..... D02G 1/02; B02G 1/20

[58] Field of Search ..... 57/140 R, 157 TS, 34 HS, 57/157 F, 34 B; 28/72.11, 1.3

[56] References Cited

UNITED STATES PATENTS

| | | | |
|---|---|---|---|
| 3,309,855 | 3/1967 | Stoll et al. | 57/34 B |
| 3,460,336 | 8/1969 | Collingwood et al. | 57/34 B X |
| 3,605,393 | 9/1971 | Schroeder | 57/34 B |
| 3,772,872 | 11/1973 | Piazza et al. | 57/140 R |
| 3,785,135 | 1/1974 | Seem et al. | 57/34 HS |
| 3,824,776 | 7/1974 | London, Jr. | 57/157 FX |

FOREIGN PATENTS OR APPLICATIONS

| | | | |
|---|---|---|---|
| 48-8364 | 6/1973 | Japan | |
| 1,029,097 | 5/1966 | United Kingdom | 28/72.11 |

OTHER PUBLICATIONS

"Research Disclosure", —Apr. 1973; p. 29.

*Primary Examiner*—John Petrakes

[57] ABSTRACT

A process for draw-texturing polyester yarn which has been melt-spun at high speed. The process is performed on a conventional false-twist texturing machine modified for drawing and for the use of an air-jet texturing device instead of a second heater. The yarn is drawn at 1.3 to 2.0X draw ratio, false-twist textured, and then air-jet textured to provide a yarn having a low boil-off shrinkage, resiliency and spun-like aesthetics.

5 Claims, 1 Drawing Figure

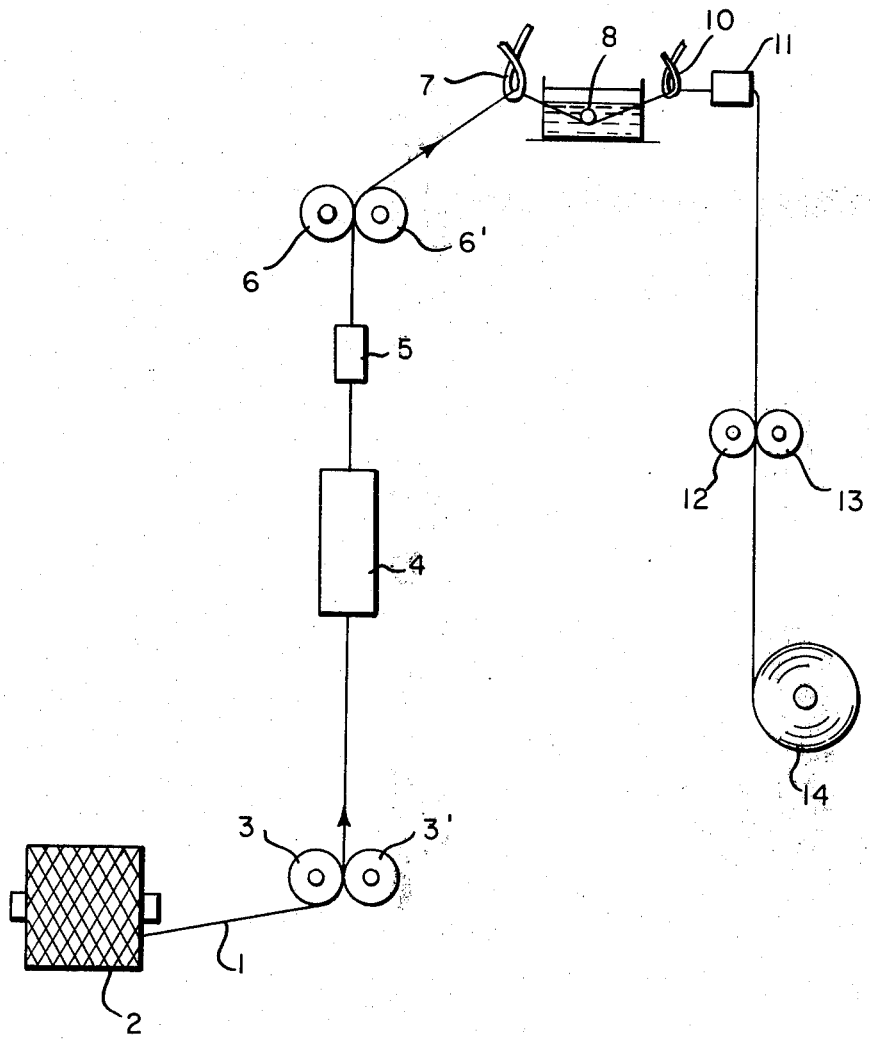
7
8
10
11
6
6'
5
4
12
13
14
3
3'
1
2

PROCESS FOR TEXTURING POLYESTER YARN

BACKGROUND OF THE INVENTION

This invention relates to production of polyester textile yarn and is more particularly concerned with continuous filament, textured yarn.

Most polyester textile yarn is produced by processes which involve melt-spinning an ethylene terephthalate polymer to form continuous filaments, drawing the filaments to provide improved tenacity and a break elongation of about 30 percent, and treating the filaments to provide bulk with low boil-off shrinkage in yarns comprising the filaments. A boil-off shrinkage of less than 3.5 percent is important for uniform dyeing of yarn packages wound without special precautions. In one conventional process, the drawn filaments are stuffer-box crimped, heat-set to stabilize the crimp and reduce the boil-off shrinkage to about 8 percent, cut to staple fiber, blended with cotton or wool, and spun into yarn by a combination of carding, drafting and twisting steps. In another conventional process, the drawn continuous filaments are gathered into a yarn which has about 8 to 10 percent boil-off shrinkage, and the yarn is then textured with an air-jet in the manner disclosed in Breen U.S. Pat. No. 2,852,906. The filaments are formed into convolutions which impart bulk and provide crunodal loops on the yarn surface which impart to fabrics an aesthetic feel similar to that provided by yarns prepared by cutting to staple fibers and spinning the fibers into yarn. In package dyeing such air-jet textured yarns, special precautions are taken in winding to produce very soft packages which allow uniform dyeing. Alternatively, the yarn may be relaxed by hot stabilization treatment, but this is costly.

In another process for texturing yarn, the filaments are helically crimped by twisting the yarn, heatsetting the twist in the yarn at temperatures above 180°C. and then untwisting the yarn. The yarn is advanced continuously over a heater to a false-twisting spindle or frictiontwisting device which backs up twist in the yarn passing over the heater. After the texturing step, the untwisted yarn is usually passed over a second heater at a slightly lower temperature than the first heater. The second heater reduces crimp contraction upon boil-off of the false-twist textured yarn, thus permitting the use of relatively firmly wound packages in package dyeing. Otherwise, excessively soft packages must be wound under low tension to permit the yarn to shrink uniformly. However, the second heating step also increases the cost of the texturing machine, maintenance and energy consumption.

SUMMARY OF THE INVENTION

The present invention provides a process for producing textile yarn having spun-like tactility, highly desirable resilience and ease of dyeing. It also provides a process which can be performed on existing false-twist texturing machines after only minor modifications and obviates the need for using a second heater for stabilizing the yarn.

The invention is a texturing process which uses a feed yarn characterized by a break elongation of 70 to 180 percent, by a birefringence value of at least 0.025, and by polyester consisting essentially of synthetic linear ethylene terephthalate polymer which is less than 30 percent crystalline and has a relative viscosity of at least 18. The yarn is fed to feed rolls of a false-twist texturing machine which is equipped with an air-jet texturing device instead of a second heater and has take-off rolls from the false-twist texturing zone which are driven faster than the feed rolls to draw the yarn. The yarn is drawn at 1.3 to 2.0 X draw ratio, false-twist textured at 20 to 70 turns per inch with a heater temperature greater than 180°C., and then air-jet textured at 8 to 35 percent overfeed to form crunodal loops. The textured yarn produced has a boil-off shrinkage of less than 3.5 percent and good stretchiness. The textured yarn provides springy and lively fabrics with desirable bulk and spun-like tactility.

Production of suitable feed yarn is disclosed in Piazza and Reese U.S. Pat. No. 3,772,872. Preferably it is composed of filaments which have been melt spun at 3000 to 5000 yards per minute. Yarn spun at less than about 3000 yards per minute causes difficulty in string-up, due to melting on the heater, and requires too high a draw ratio. Preferably a coefficient of interfilament friction ($f_s$) of less than about 0.38 is provided as disclosed in the patent. Preferably the feed yarn has substantially zero twist and is interlaced, as disclosed in Bunting et al. U.S. Pat. No. 2,985,995, to a pin count of about 20 to 40 inches.

Preferably the yarn is false-twist textured within the range of about 22 to about 50 turns per inch, as this gives excellent loop stability in the final product. Preferably a heater plate temperature of about 200° to 225°C. is used. The yarn speed can be higher than usual for the machine used.

The air-jet texturing device is preferably as disclosed in Lubach U.S. Pat. No. 3,545,057 or Becher U.S. Pat. No. 3,097,412. Preferably the yarn is wet when fed to the air-jet device, e.g., by passage through a water bath as illustrated, but this is not essential. Preferably the yarn is air-jet textured at about 20 percent overfeed. Two or more ends of yarn from adjacent positions on texturing machines may be combined and fed to the air jet to provide bulked yarn of higher denier which would otherwise have to be made by costly ply twisting.

BRIEF DESCRIPTION OF THE DRAWING

The drawing shows a diagrammatic representation of an embodiment of the process and suitable equipment for practicing the invention.

DEFINITIONS AND MEASUREMENTS

Break Elongation and Tenacity are measured according to the ASTM designation D-2256-69 (incorporating editorial edition of Section 2 and renumbering of subsequent sections as done in March 1971). It is defined as in Option 3.3 "Elongation at Break" of Section 3. The testing is performed on straight multifilament yarns which were conditioned by storing them at 65 percent relative humidity and 70°F. (21.1°C.) for 24 hours prior to testing. An Instron Tensile Testing Machine is used. The test sample is 5 inches (12.7 cm.) long, no twist is added, the crosshead speed is 10 inches/minute (25.4 cm./min.), the rate of attenuation is 200 percent/minute, and the chart speed is 5 inches/minute (12.7 cm./min.). Tenacity is the maximum load in grams, before the yarn breaks, divided by the denier of the yarn.

Interfilament Boundary Coefficient of Friction is a measure of the ease with which filaments slip by each other and is determined as described in Piazza and Reese U.S. Pat. No. 3,772,872, at column 2. About 750 yards (686 meters) of yarn are wrapped (using a helix angle of 15° and a winding tension of about 10 grams) around a cylinder which is 2 inches (5.08 cm.) in diameter and 3 inches (7.6 cm.) long. A 12 inch length (30.5 cm.) of the same yarn is placed over the top of the cylinder so that it rests on top of the wrapped yarn and is directed perpendicular to the axis of the cylinder. One end of the overlaid yarn supports a weight and the other end of the yarn is attached to a strain gauge. The value of the weight, in grams, is equal to about 0.04 times the denier of the overlaid yarn. The cylinder is then rotated one half revolution (180°) at a peripheral speed of about 0.0016 cm./sec., so that the strain gauge is under tension. The tension is continuously recorded. Samples in which permanent elongation occurs are discarded. The boundary coefficient of friction, ($f_s$), is calculated with the belt equation:

$$T_2/T_1 = e^{af_s}$$

where $T_2$ is the average of at least 25 recorded peak tension values, in grams, $T_1$ is the input tension (0.04 gm. times the denier), a is the angle, in radians, of the wrap described by the overlaid yarn on the cylinder, and $e$ is 2.718, the base of natural logarithms.

The above test is carried out at approximately 70° ± 1°C., and results are recorded as $f_s$ values.

Birefringence is measured as disclosed in Kitson et al. U.S. Pat. No. 3,549,597, at column 4, lines 11–28.

Crystallinity may be determined from simple density measurements. The density is measured by the procedure disclosed in Kitson et al. U.S. Pat. No. 3,549,597, at column 3, line 46, to column 4, line 10. Carbon tetrachloride and n-heptane are suitable liquids for use with polyethylene terephthalate. The percent crystallinity is derived from the density measurements by linear interpolation between the density of a fully amorphous sample (1.335 gm./cc.) and the density of the crystalline phase (1.455 gm./cc.). For copolymers or fibers containing additives, such as $TiO_2$, appropriate adjustments should be made as described in Kitson et al. U.S. Pat. No. 3,549,597.

Boil-off Shrinkage is obtained by suspending a weight from a skein of yarn to produce a 0.1 gm./denier load on the yarn and measuring its length ($L_o$). The weight is then replaced by lighter weight generating a 0.005 gm./denier load and the loaded yarn is immersed in boiling water for 30 minutes. The yarn is then removed, air dryed, loaded again with the original weight, and its new length recorded ($L_f$). The percent shrinkage is calculated by using the formula:

$$\text{Shrinkage } (\%) = (L_o - L_f)/L_o \times 100$$

Relative Viscosity (RV) values of the polyesters used in the examples are given as a measure of the molecular weight. Relative viscosity (RV) is the ratio of the viscosity of a solution of 0.8 gm. of polymer dissolved at room temperature in 10 ml. of hexafluoroisopropanol containing 80 ppm $H_2SO_4$ to the viscosity of the $H_2SO_4$ containing hexafluoroisopropanol itself, both measured at 25°C. in a capillary viscometer and expressed in the same units.

Interlace pin count is the length of yarn in inches that passes by probe 18 of Hitt U.S. Pat. No. 3,290,932 before the probe is deflected about 1 mm. A force of about 8 grams is required to deflect the probe.

DETAILED DISCLOSURE

An embodiment of the new process is shown in the drawing. Spin-oriented yarn 1 is led from package 2 by a pair of feed rollers, 3 and 3'. It then passes through heater 4 and false-twister 5 to a pair of draw rolls 6 and 6'. In the process the yarn is in a twisted state as it passes through heater 4. Draw rolls 6 and 6', run at a faster speed than the feed rolls to draw the yarn 1.3–2X. The yarn then goes through pigtail guide 7 and under glass deflector rod 8 which is immersed in bath 9 containing roomtemperature water. It then passes through pigtail guide 10 and air-jet-bulking device 11, between take up rollers 12 and 13 and is finally wound on package 14. Take up rollers 12 and 13 may be replaced by a tension gate.

The feed yarn used in the new process is a spinoriented yarn. Such yarns are described in Piazza & Reese U.S. Pat. No. 3,772,872. These yarns have high molecular orientation which is a result of the high spinning speeds used in their manufacture. Their birefringence is greater than about 0.025. They have less than 30% crystallinity and between 70% and 180% break elongation. Preferably, as disclosed in U.S. Pat. No. 3,772,872, the yarns also have a coefficient of interfilament friction ($f_s$) of less than about 0.38, provided by appropriate selection of finish, or by incorporation of polyoxyethylene glycol or pyrophosphate coated kaolinite in the polymer.

This invention includes a false-twist texturing step wherein the yarn is drawn 1.3–2.0x in the twist zone. Such a draw texturing process is disclosed in the above Piazza et al. patent. Suitable machines are, for example, the ARCT-479 and 480, manufactured by Ateliers Roannais de Construction Textiles, of France; a Leesona false-twist texturing machine of the type shown in Chalfant et al. U.S. Pat. No. 3,292,354; or the Scragg Super-Draw-Set II (SDS II), available from Ernest Scragg and Sons, Macclesfield, England.

In the false-twist step of the present invention, the heater temperature is at a conventional temperature above 180°C., usually about 210°C.

The air-jet bulking apparatus produces crunodal surface loops. Preferred jets are disclosed in Lubach U.S. Pat. No. 3,545,057 and Becher U.S. Pat. No. 3,097,412. To improve the efficiency of the jet, the yarn is preferably first immersed in a water bath, although this is not an essential aspect of the present invention. The percent overfeed to the jet; that is, $$\frac{\text{Feed Speed minus Takeup Speed}}{\text{Feed Speed}} \times 100$$

can be set as desired from about 8 to about 35, but is preferably about 20. The yarn is preferably underfed to the package. Percent underfeed; that is, $$\frac{\text{Take up Speed minus Package Speed}}{\text{Take up Speed}} \times 100$$

can be set as desired from about −1 to about −10, but is preferably about −5.

In the new process textured yarn has the surprising combination of low shrinkage, spun-like tactility and good resilience. Resilience provides springy and lively fabrics, characteristic of fine worsteds.

EXAMPLES

Spin-oriented polyethylene terephthalate yarns are made by standard melt-spinning techniques except that the freshly extruded filaments are pulled from the spinneret by means of puller rollers running at 3400 yd./min. (3110 m./min.). Quenching is by a forced flow of 21.1°C. air. The puller rollers are about 20 feet (6.1m.) below the spinneret. Downstream of the puller rollers the yarns contact a roller immersed in a finish bath. The finish is a 12% aqueous solution of a mixture comprising 97 parts of a 2900 number average molecular weight polyoxyalkylene block copolymer:$HO(C_2H_4O)_m(C_3H_6O)_n(C_2H_4O)_pH$, wherein m, n, and p are integers, consisting of 40% (all percentages herein are by weight) oxyethylene and 60% oxy-1,2-propylene groups. The mixture also contains 1 part sodium dioctylsulfosuccinate, 0.5 part triethanol amine, 0.5 part oleic acid, 0.5 part 4,4′ butylidene-bis(6-t-butyl-m-cresol) and 0.5 part tris(nonylphenyl)phosphite.

Just before windup, the yarns pass through an interlace jet supplied with room temperature air at 20 psig (1.406 kg./cm.$^2$) pressure to produce 40-inch (102 cm.) interlace pin count.

The polymer in these yarns is less than 30% crystalline.

Three of the spin-oriented yarns are draw-textured on commercial false-twist texturing machines modified to draw them in the twist zone. No stabilizing heater is used. As the yarns exit from the draw zone, they are fed to a wetting trough as shown in the drawing, through a bulking jet and are finally wound up.

Process and product details are shown in Table I. The yarn of each sample contain desirable surface loops and the filaments are crimped helically. Surprisingly, the yarns have less than 3.5% boil-off shrinkage. Sample number (1) is a bulked loopy yarn of 184 denier and has boil-off shrinkage of 3.1%. The run is repeated again under identical conditions, producing a similar bulky loopy yarn with 3.0% boil-off shrinkage and 191 denier. The yarn from the repeat run is pressure package-dyed maroon color without special precautions, such as a very soft package wind up, yielding excellent dye uniformity through the package. The dyed yarn is made into doubleknit Ponte-di:Roma fabric which is worsted-like, lively, springy and possesses other desirable tactile aesthetics. Sample number (2) is a bulky loop yarn which is knitted without package dyeing to Ponte-di-Roma doubleknit fabric. The griege fabric is beck scoured, then dyed in pressure jet dyer, dried, heat set, re-scoured with the addition of a surface softener, and finally dried. The finished fabric does not show shrinkage and concomitant weight increase typical of high boil-off shrinkage (~8%) air-jet bulked polyester yarn. The fabric is worsted-like, lively, springy and possesses other desirable tactile aesthetics. Sample number (3) is run on a different machine, but the yarn is still bulky, loopy with boil-off shrinkage of 3.0%. The yarn is pressure package-dyed blue-grey color without special precautions such as a very soft package wind up, yielding excellent dye uniformity through the package. The dyed yarn is made into doubleknit Ponte-di-Roma fabric which is worsted-like, lively, springy and possesses other desirable tactile aesthetics.

The yarns from the process of the present invention are not restricted to knitted fabric structures. In boiled-off fabrics woven from yarns which are not dyed, they provide both worsted-like tactility and adequate stretch.

TABLE I

| Feed Yarn and Process<br>Sample Number | 1 | 2 | 3 |
|---|---|---|---|
| Polymer RV | 20 | Same | Same |
| $TiO_2$ content (by wt.) | 0.3% | ↕ | ↕ |
| Spinneret temperature | 290°C. | ↕ | ↕ |
| Spinneret orifice size<br>Diameter × length (mils)/(mm.) | 11×20 (.27×.51) | ↕ | ↕ |
| Puller roll speed (yd./min.) | 3400 | ↕ | ↕ |
| Windup speed (yd./min.) | 3400 | ↕ | ↕ |
| RV of polymer in yarn | 20 | ↕ | ↕ |
| Denier/number of filaments | 245/68 | ↕ | ↕ |
| Non-aqueous finish on yarn (wt. %) | 0.6% | ↕ | ↕ |
| Break elongation (%) | 126 | ↕ | ↕ |
| Birefringence | ~.040 | ↕ | ↕ |
| Boil-off shrinkage (%) | ~55% | ↕ | ↕ |
| Interfil. boundary<br>Coeff. of friction ($f_s$) | ~0.30 | Same | Same |
| **False-Twist Process** | | | |
| Machine Type | ARCT-480 | ARCT-480 | SCRAGG SDS II |
| Heater temp. in twist zone (°C.) | 210 | 210 | 215 |
| Draw roller speed (yd./min.)/(m./min.) | 190 (174) | 190 (174) | 385 (351) |
| Draw ratio | 1.65× | 1.65× | 1.60× |
| Spindle speed (rev./min.) | 304,000 | 304,000 | 550,000 |
| False "S" twist in yarn<br>(turns/inch)/(turns/meter) | 45 (1770) | 45 (1770) | 40 (1575) |
| Machine second heater | Not used | Not used | Not heated |
| **Air Jet Process** | | | |
| Air-bulking jet Patent Reference | U.S. 3,545,057 | Same | Same |
| Overfeed to jet (%) | 22 | 22 | 19.5 |
| Air pressure to jet (psig)/kg./cm$^2$) | 75 (5.1) | 80 (5.4) | 100 (6.8) |
| Underfeed to package (%) | −5 | −2 | * |
| Package windup speed (yd./min.)/(m./min.) | 153 (140) | 153 (140) | 309 (283) |
| Bulked yarn boil-off shrinkage (%) | 3.1 | — | 3.0 |
| Bulked yarn denier | 184 | — | 185 |

* tension gate set for 25 gm.

COMPARISON EXAMPLES

The following examples illustrate drawing and airjet texturing without false-twist texturing. The process is performed on the ARCT-480 machine used in Examples 1 and 2, but the false-twisting device is removed.

TABLE II

| Feed Yarn and Process<br>Sample Number | A | B | C |
|---|---|---|---|
| Polymer RV | 20 | Same | Same |
| $TiO_2$ content (by wt.) | 0.3% | ↕ | ↕ |
| Spinneret temperature | 290°C. | ↕ | ↕ |
| Spinneret orifice size<br>Diameter × length (mils)/(mm.) | 11×20 (.27×.51) | ↕ | ↕ |
| Puller roll speed (yd./min.) | 3400 | ↕ | ↕ |
| Windup speed (yd./min.) | 3400 | ↕ | ↕ |
| RV of polymer in yarn | 20 | ↕ | ↕ |
| Denier/number of filaments | 245/68 | ↕ | ↕ |
| Non-aqueous finish on yarn (wt. %) | 0.6% | ↕ | ↕ |
| Break elongation (%) | 126% | ↕ | ↕ |
| Birefringence | ~.040 | ↕ | ↕ |
| Boil-off shrinkage (%) | ~55% | Same | Same |
| Drawing Process | | | |
| Machine Type | ARCT-480 | ARCT-480 | ARCT-480 |
| First heater temperature (°C.) | 210 | 210 | 210 |
| Draw roller speed (yd./min.)/(m./min.) | 150 (137) | 190 (174) | 190 (174) |
| Draw ratio | 1.65× | 1.65× | 1.60× |
| Machine second heater | Not used | Not used | Not used |
| Air Jet Process | | | |
| Air-bulking jet Patent reference | U.S. 3,545,057 | U.S. 3,097,412 | U.S. 3,545,057 |
| Overfeed to jet (%) | 25 | 22 | 22 |
| Air pressure to jet (psig)/(kg./cm²) | 80 (5.4) | 74 (5.0) | 80 (5.4) |
| Underfeed to package (%) | −5 | −5 | −5 |
| Package windup speed (yd./min.)/(m./min.) | 118 (108) | 153 (140) | 153 (140) |
| Bulked yarn boil-off shrinkage (%) | 2.5 | 3.1 | 3.0 |
| Bulked yarn denier | 186 | 181 | 189 |

Three of the spin-oriented feed yarns described above are drawn on an ARCT-480 machine equipped with a typical 40 inch (100 cm.) heater. No false-twisting device and no second heater are used. As each yarn exits from the draw zone, the yarn is fed directly to a wetting through (as illustrated in the drawing), through the air-jet texturing device, and is then wound up.

Process and product details are shown in Table II. The yarn of each sample contains desirable surface loops and all yarns have less than 3.5% boil-off shrinkage. Sample (A) is a bulky loopy yarn of 186 denier and has 2.5% boil-off shrinkage. After pressure package-dyeing to a red color, without special precautions such as a very soft package wind up tension, the dye uniformity is excellent. The dyed yarn is made into doubleknit Ponte-di-Roma fabric which is worsted-like and possesses other desirable tactile aesthetics. Sample (B), which is processed through a different air-jet, is bulky, loopy and has 3.1% boil-off shrinkage. The yarn is knitted, without package-dyeing, to Ponte-di-Roma doubleknit fabric. The griege fabric is beck scoured then dyed in a pressure jet dyer, dried, heat set, rescoured with the addition of a surface softener, and finally dried. The finished fabric, which is worsted-like and possesses other desirable tactile aesthetics, does not show shrinkage and concomitant weight increase typical of high boil-off shrinkage (~8%) air-jet bulked polyester yarns of the prior art. Sample (C) is a bulky, loopy yarn of 189 denier and has 3.0% boil-off shrinkage. After pressure package-dyeing to a brown color, without special precautions such as a very soft package wind up tension, the dye uniformity is excellent. The dyed yarn is made into doubleknit Ponte-di-Roma fabric which is worsted-like and possesses other desirable tactile aesthetics.

I claim:

1. In the process for producing textured polyester yarn wherein synthetic linear ethylene terephthalate polymer is meltspun into filaments at 3000 to 5000 yards per minute to form a yarn characterized by a break elongation of 70 to 180 percent, by a birefringence value of at least 0.025, and by polyester which is less than 30 percent crystalline and has a relative viscosity of at least 18, and the yarn is drawn and textured in a draw-twist zone of a false-twist texturing machine with a heater temperature of at least 180°C; the improvement which comprises draw-texturing the yarn at 1.3 to 2.0 draw ratio and 20 to 70 turns per inch twist in said draw-twist zone, feeding the yarn from the draw-twist zone to an air jet at 8 to 35 percent overfeed without additional heating, jet-texturing the yarn with the air jet to form crunodal surface loops in the yarn, and packaging the resulting textured yarn at a package speed (P) greater than the takeup speed (T) from the air jet, the value of $$\left(\frac{T-P}{T}\right)(100)$$

being from −1 to −10 percent.

2. The process defined in claim 1 wherein the yarn is false-twist textured at 22 to 50 turns per inch.

3. The process defined in claim 2 wherein the yarn is false-twist textured at a heater temperature of 200° to 225°C.

4. The process defined in claim 1 wherein the yarn is wet when fed to the air-jet texturing step.

5. The process as defined in claim 4 wherein the yarn is air-jet textured at about 20 percent overfeed.

* * * * *